United States Patent [19]

Ries

[11] Patent Number: 4,678,413

[45] Date of Patent: Jul. 7, 1987

[54] VARIABLE DISPLACEMENT VANE PUMP OR MOTOR

[76] Inventor: Edward Ries, 450 Porter La., San Jose, Calif. 95127

[21] Appl. No.: 821,485

[22] Filed: Jan. 22, 1986

[51] Int. Cl.[4] ..... F01C 21/16; F04C 15/04

[52] U.S. Cl. ..... 418/29; 418/138

[58] Field of Search ..... 418/29, 182, 259, 16, 418/266–270

[56] References Cited

U.S. PATENT DOCUMENTS 1,652,317 12/1927 Morgan ..... 418/29

2,815,647 12/1957 Albrecht ..... 418/29

3,834,841 9/1974 Falciai ..... 418/29

*Primary Examiner*—Carlton R. Croyle

*Assistant Examiner*—Jane E. Obee

[57] ABSTRACT

A variable displacement pump/motor characterized by a housing, a rotary shaft assembly disposed of within the housing, a plurality of hinged vanes engaged with the rotary shaft assembly, and an offset rotor assembly engaged with the vanes and having its own axis of rotation. The output of the pump or motor is changed by varying the axis of rotation of the rotor relative the axis of rotation of the rotary shaft assembly. A pair of counter rotating eccentrics are used to smoothly vary the axis of rotation of the rotor along a plane which is common to the axis of rotation of the rotor and the axis of rotation of the shaft assembly. The output of the pump/motor can be varied smoothly between a maximum in a first direction, to zero, to a maximum in a an opposite direction, and back again.

4 Claims, 10 Drawing Figures

FIG-8-
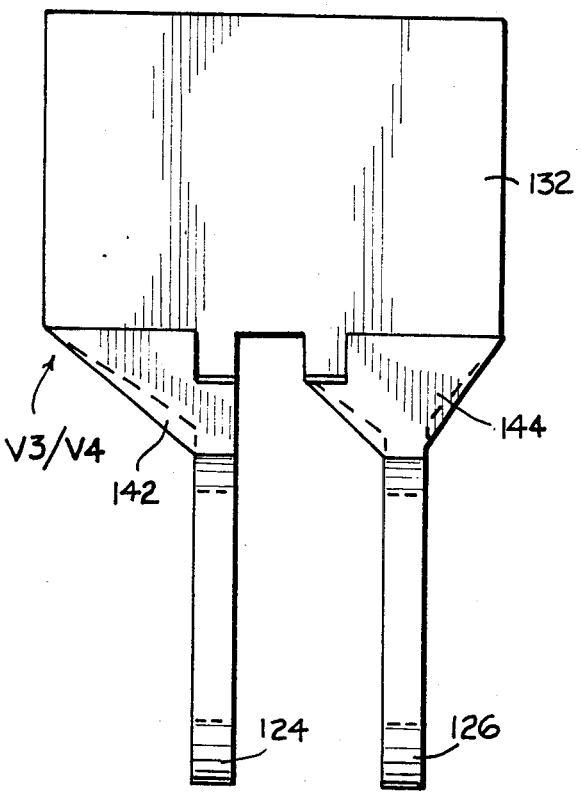
FIG-9-
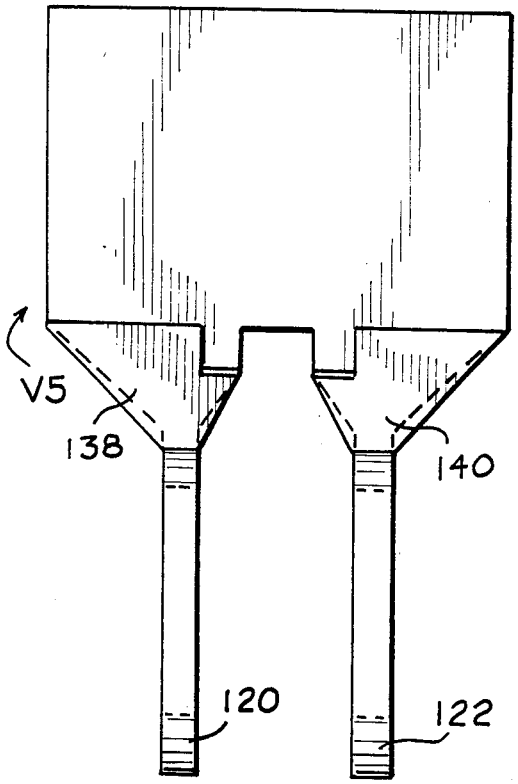
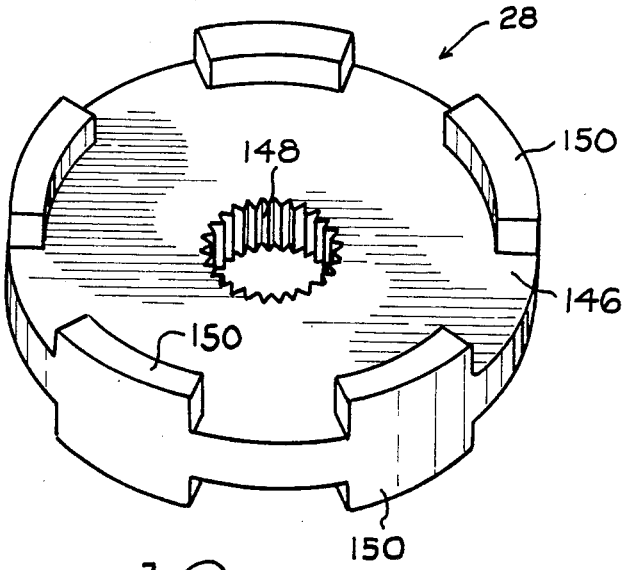
FIG-10-

VARIABLE DISPLACEMENT VANE PUMP OR MOTOR

BACKGROUND OF THE INVENTION

1. Field of the Invention

This invention relates generally to rotary vane pumps or motors and in particular to vane pumps having variable displacement.

2. Description of the Prior Art

There are many different types of rotary vane pumps, most of which employ an externally rotated shaft that is offset within the axis of the pump housing and has a series of equally spaced radial slots each having a spring biased paddle or pump vane. The outer end of the vanes brush against the circular interior surface of the housing to force fluid from an intake port to an output port. If used as a motor, such a pump will receive steam, compressed gas or pressurized liquid to force rotation of the vane assembly.

A second type of rotary vane pump operates in the same manner but employs a rotary vane assembly having a rotating axis that is offset from the axis of the powered input shaft. The base of each vane is freely hinged to the vane assembly axis centered in the circular housing and rotatable in a bushing in one side of the pump housing. The hinged vane assembly is rotated by a rotor coupled to the input shaft entering the pump housing from the opposite side. Since the vane assembly axis is displaced from the input shaft axis, the vane ends force fluid from inlet to outlet in the same manner discussed above. A typical rotary van pump or motor of this type is described in U.S. Pat. No. 3,892,502 of Pritchard, dated July 1, 1975.

An improvement to the rotatable vane pump with the offset shaft and vane assembly axes described above is one in which the amount of offset may be varied, such as described in U.S. Pat. No. 3,807,912 of Keller, dated Apr. 30, 1974. Here, a radially aligned rack operated by an external pinion gear adjusts the diametrical position of a secondary or interior circular housing with a hinged rotatable vane assembly centered therein. The pump input shaft rotates a rotor assembly which slideably engages each vane for rotating the vane assembly. The advantage of such a pump over those discussed above is that its displacement is variable so that at a constant rotational input velocity it may control flow and pressure and also the direction of flow.

The input shaft of Keller's device moves relative to the primary pump housing. This movement requires a second, larger housing for containment purposes. The primary pump housing must be fairly massive to withstand several thousand P.S.I. of internal pressure. When a second housing is added around the primary housing, Keller's device becomes too large for use in many applications.

Furthermore, Keller achieves variable displacement by moving a "control device" subassembly back and forth by means of a rack and pinion. The control device divides the outer cavity into low pressure and high pressure regions, which results in large lateral forces on the control device. Due to the large, unbalanced forces exerted on the control device, it must be made massive and rigid, which adds to the cost and weight of Keller's device.

SUMMARY OF THE INVENTION

A principal object of the invention is to provide a pump having a smooth control for varying the flow between a maximum in one direction, through an absence of flow and to a maximum flow in the opposite direction.

Another object of this invention is to provide a variable displacement pump which, due to its novel design, can be made smaller than pumps of similar capabilities in the prior art.

Yet another object of this invention is to provide a variable displacement pump which has a control mechanism that is not subject to large, unbalanced fluid forces.

Briefly described, the adjustable displacement rotary vane pump of the present invention includes an externally powered input shaft supporting a plurality of vanes, the outer edges of which contact the interior surface of a circular housing. Splined to the input shaft is a crown shaped drive plate having gaps therein for loosely engaging the central inner areas of the vanes. The crown shaped drive plate generally engages one vane at a time, and transmits torque through the vane to the rotor to cause the rotor to move with the same rotational velocity as the drive plate. The remaining vanes, being slidingly engaged with the rotor, are caused to rotate with the rotor.

The rotor is positioned in the housing by a pair of counter-rotating eccentric rings, which are smoothly controlled in unison by a gear train rotated by an externally rotated input shaft. The eccentrics position the rotor in such a manner that its axis of rotation may be moved in directions parallel to the input shaft's axis of rotation to vary the displacement of the pump.

An advantage of this invention is that it can be made smaller and lighter than prior art pumps of the same capacity.

Another advantage of this invention is that the forces exerted on the adjustment mechanism (i.e. the eccentrics) is transmitted directly to the housing in a balanced manner.

Yet another advantage of this invention is that the pump can be smoothly controlled for varying the flow between a maximum in one direction, through the absence of flow, and to a maximum in the opposite direction.

These and other objects and advantages of the present invention will no doubt become apparent upon a reading of the following descriptions and a study of the several figures of the drawing.

BRIEF DESCRIPTION OF THE DRAWING

FIGS. 7, 8, and 9 are detail views of the remaining vanes of the pump; and FIG. 10 is a perspective view of the vane drive element.

DETAILED DESCRIPTION OF THE PREFERRED EMBODIMENT(S)

The variable displacement machine of the present invention is capable of operating either as a pump or as a motor. For purposes of description, the machine will be described as a pump, it being understood that it can operate equally well in a reverse mode as a fluid powered motor.

Figure 1:
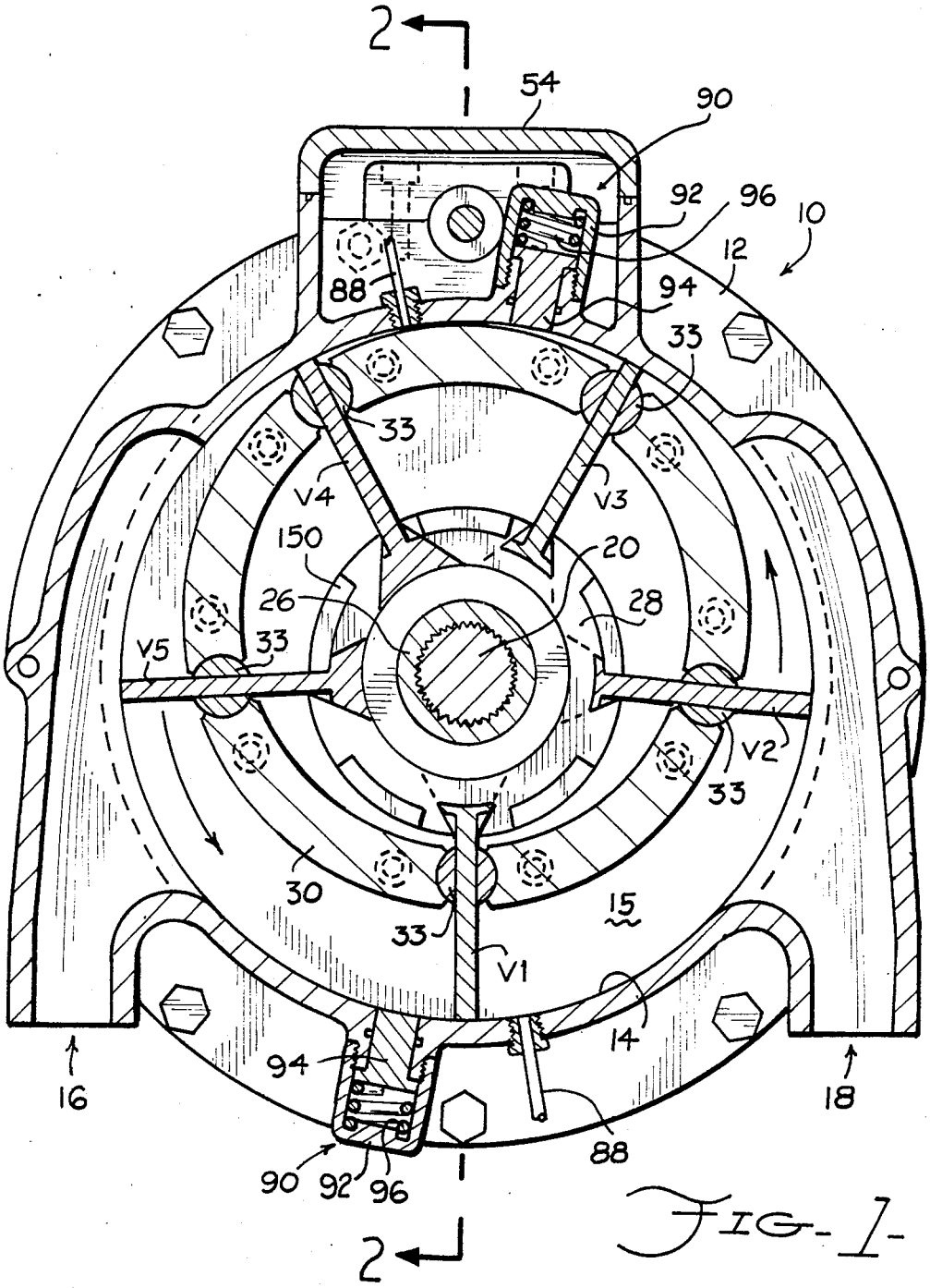
FIG. 1 is a sectional view through the central portion of the variable displacement vane pump and taken along the lines 1—1 of FIG. 2.
Figure 2:
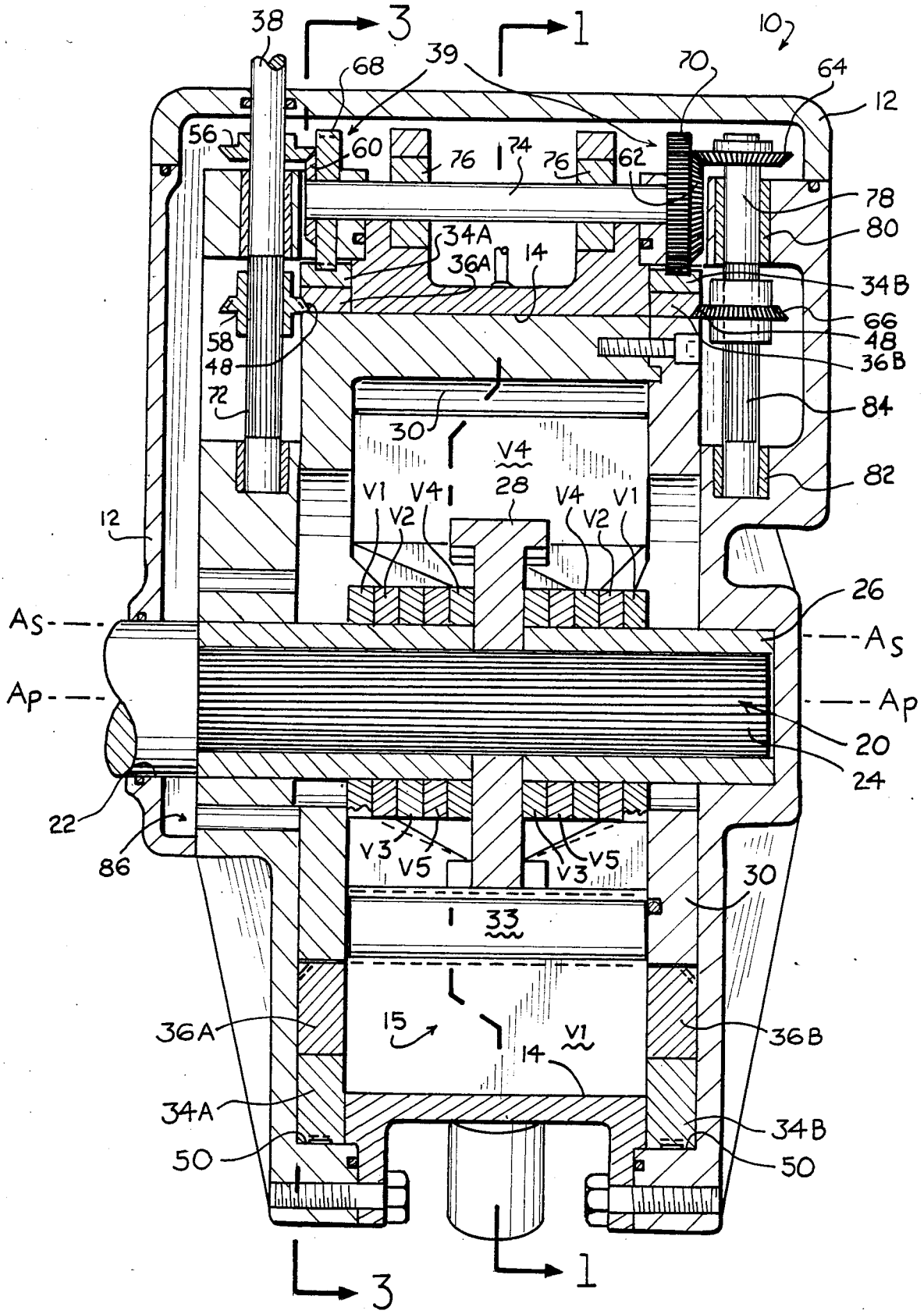
FIG. 2 is a sectional view taken along the lines 2—2 of FIG. 1.
Figure 3:
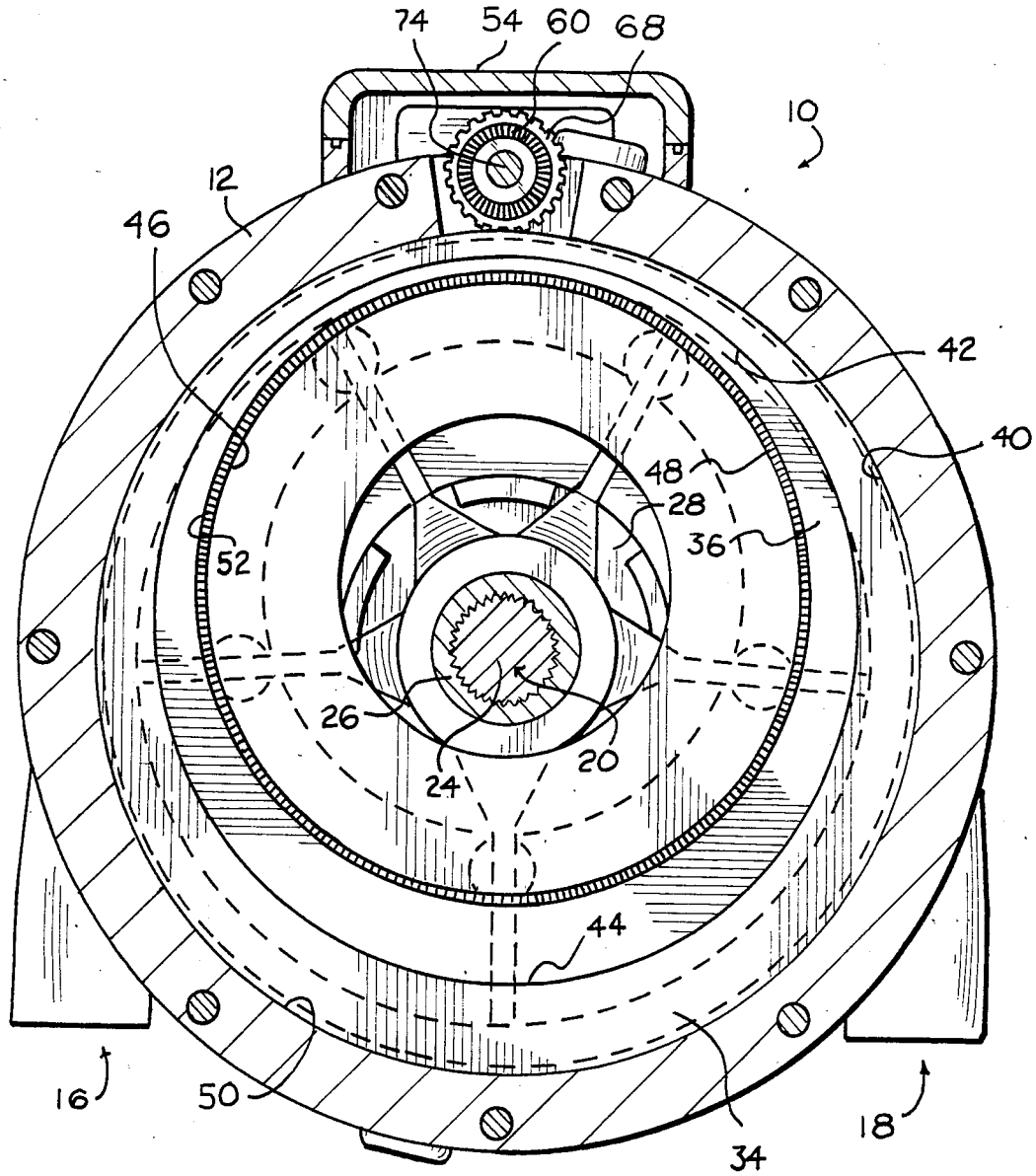
FIG. 3 is a sectional view taken along the lines 3—3 of FIG. 2.

Referring generally to FIGS. 1–3, a variable displacement pump 10 in accordance with the present invention includes a housing 12 having a substantially cylindrical inner surface 14 surrounding and defining a pump chamber 15, and a pair of orifices 16 and 18. The housing 12 encloses the mechanism of the pump, and is sealed against leakage.

A rotary shaft assembly 20 extends into housing 12 at an opening 22 in the housing, and includes a splined core 24, a bearing member 26, and a drive plate 28. The rotary shaft assembly 20 has a primary axis of rotation $A_p$.

Five vanes labeled V1, V2, V3, V4, and V5 are loosely coupled to rotary shaft assembly 20. As will be discussed in greater detail subsequently, the vanes V1–V5 are actually hinged to rotary shaft assembly 20 in the sense that the five vanes are attached to the axis $A_p$ in the same manner that the two plate members of a hinge are attached to a hinge pin.

A rotor assembly 30 is disposed around rotary shaft assembly 20 and through the pump chamber of housing 12. Rotor assembly 30 rotates around a secondary axis $A_s$ which is parallel to, but usually not coaxial with, primary axis $A_p$.

As best seen in FIG. 1, the rotor assembly 30 is provided with 5 slotted, cylindrical bearings 33 through which vanes V1–V5 extend to contact the cylindrical inner surface 14 of housing 12. Bearings 33 provide a sliding seal between the rotor 30 and vanes V1–V5.

As best seen in FIGS. 2 and 3, an adjustment assembly includes a pair of outer eccentric plates **34*a* and 34*b*, a pair of inner eccentric plates 36*a* and 36*b*, and a gear assembly 39 which causes outer plates 34*a/b* and inner plates 36*a/b* to rotate in opposite directions when an adjustment shaft 38** is rotated.

Still referring primarily to to FIGS. 2 and 3, outer eccentric plates **34*a/b* have a first outer surface 40 which is substantially circular, and a first inner surface 42 which is substantially circular but which is offset from the center of the plate. Similarly, inner eccentric plates 36*a/b* include a second outer surface 44 which is substantially circular, and a second inner surface 46 which is also substantially circular and which is offset from the center. Surface gears 48 are provided near second inner surface 46 of inner eccentric plates 36*a/b***.

As best seen in FIG. 2, outer eccentric plates **34*a/b* can rotate within a race surface 50 of housing 12. The second outer surface 44 of inner eccentric plates 36*a/b* engages the first inner surface 42 of outer eccentric plates 34*a/b*. The outer surface 52 of rotor assembly 30 engages the second inner surface 46 of the inner eccentric plates 36*a/b*. In consequence, rotor assembly 30 can rotate within inner eccentric plates 36*a/b*, inner eccentric plates 36*a/b* can rotate within outer eccentric plates 34*a/b*, and outer eccentric plates 34*a/b* can rotate within race surface 50 of housing 12**.

The adjustment gear assembly 39 is located within a gear box 54 of housing 12. Besides adjustment shaft 38, the adjustment gear assembly includes bevel gears 56, 58, 60, 62, 64, and 66, and spur gears 68 and 70. Bevel gear 56 is affixed to input shaft 38 and engages bevel gear 60, and bevel gear 58 is slidingly engaged with splines 72 of adjustment shaft 38 and engages surface gear 48 of inner eccentric plate **36*a*. Bevel gear 60 is affixed to a horizontal shaft 74, as are gears 68, 70, and 62. Shaft 74 is supported by bearings 76**.

Spur gears 68 and 70 engage a recessed spur gear surface in outer eccentric plates **34*a* and 34*b*. It should be noted that the gear engagement between bevel gear 56 and 60 causes shaft 74 to rotate such that the outer eccentric plates 34*a/b* rotate together and in a direction opposite to that of inner eccentric plates 36*a/b***.

Bevel gear 62 engages bevel gear 64, which is attached to the end of a vertical shaft 78 which is supported by bearings 80 and 82. Bevel gear 66 is supported along a splined portion 84 of vertical shaft 78 and engages the surface gear 48 of inner eccentric plate 36. Bevel gear 66, as was in the case of bevel gear 58, can move up and down along its shaft.

It will be appreciated that rotation of shaft 38 will cause the outer eccentric plates **34*a/b* to rotate in an opposite direction from the inner eccentric plates 36*a/b*. As the inner eccentric plates 36*a/b* are rotated, the bevel gears 58 and 66 are caused to move up and down along the respective shafts such that they are always engaged with the surface gears 48 of the inner eccentric plates 36*a/b***.

The outer eccentric plates 34 and inner eccentric plates 36 are designed such that rotation of shaft 38 causes the axis $A_s$ to move along a vertical plane which includes the axes $A_s$ and $A_p$. When the rotor assembly 30 is in the position shown in FIGS. 1–3 and is rotating in a counterclockwise direction as seen from FIG. 1, fluid will be forced from orifice 16 to orifice 18. If the axis $A_s$ is brought into alignment with the axis $A_p$ the rotor assembly 30 will be coaxial with rotary shaft assembly 20, and no fluid will be pumped. If the axis $A_s$ is adjusted to be below the axis $A_p$, the direction of fluid flow will reverse, i.e. the fluid will flow from orifice 18 to orifice 16. In consequence, both the displacement and the direction of the fluid flowing from pump 10 can be varied smoothly and continuously even though the torque applied to rotary shaft assembly 20 is held constant.

Referring more specifically to FIGS. 1 and 2, it is inevitable that a certain amount of fluid will leak into voids within pump 10, such as the void indicated at 86. This fluid can be collected and routed to reinjection orifices 88 which are strategically placed around cylindrical inner surface 14. As the vanes rotate past the reinjection orifices 88, a pressure differential is created which draws the fluid back into the pump chamber 15 of the pump. Preferably, the reinjection orifices 88 should be provided with check valves (not shown) to keep the fluid from flowing in the opposite direction.

The present invention is also provided with a pair of fluid accumulator assemblies 90 including a cylinder 92, a piston 94, and a spring 96 biasing the piston towards pump chamber 15. Since liquids are incompressible, the fluid accumulator assemblies 90 provide temporary storage of high pressure fluid which are subsequently reinjected into the pump chamber 15.

Figure 4:
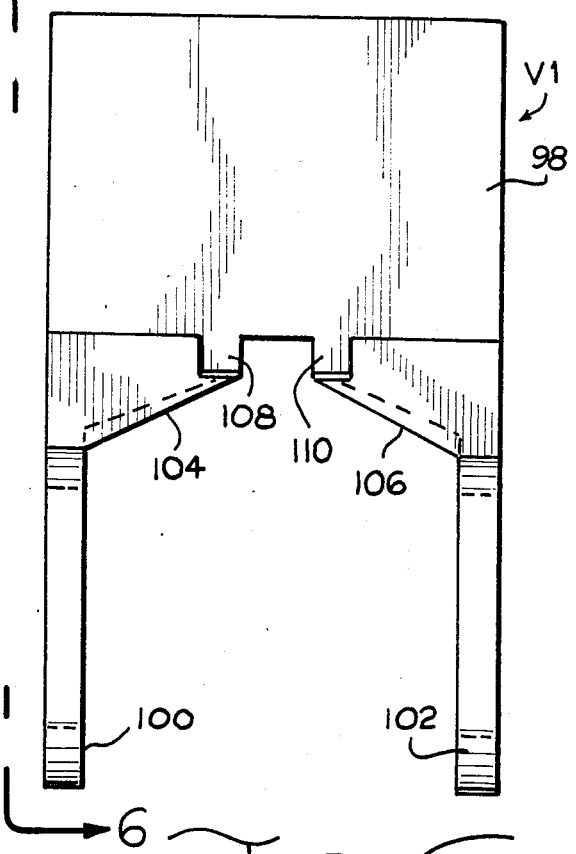
FIGS. 4, 5, and 6 are detail and sectional views of one of the vanes of the pump.
Figure 5:
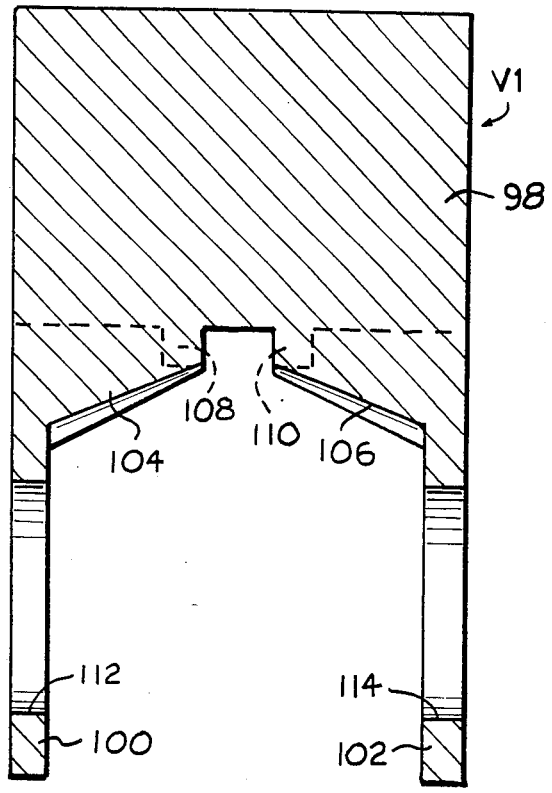
Figure 6:
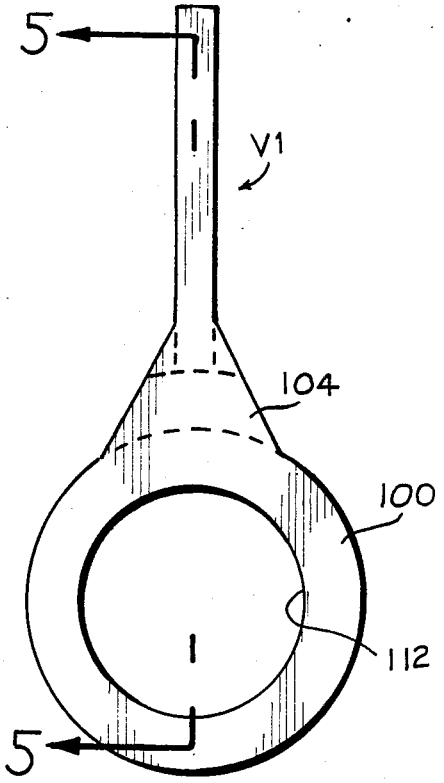

Referring now to FIGS. 4–6, the vane V1 will be discussed in greater detail. The vane V1 includes a blade 98, a pair of O-shaped members 100 and 102, and connecting sections 104 and 106. The connecting sections are provided with shoulders 108 and 110 which are engaged by the drive plate 28. O-shaped bearing members 100 and 102 have cylindrical inner bearing surfaces 112 and 114, respectively, which engage the circumference of bearing member 26.

Figure 7:
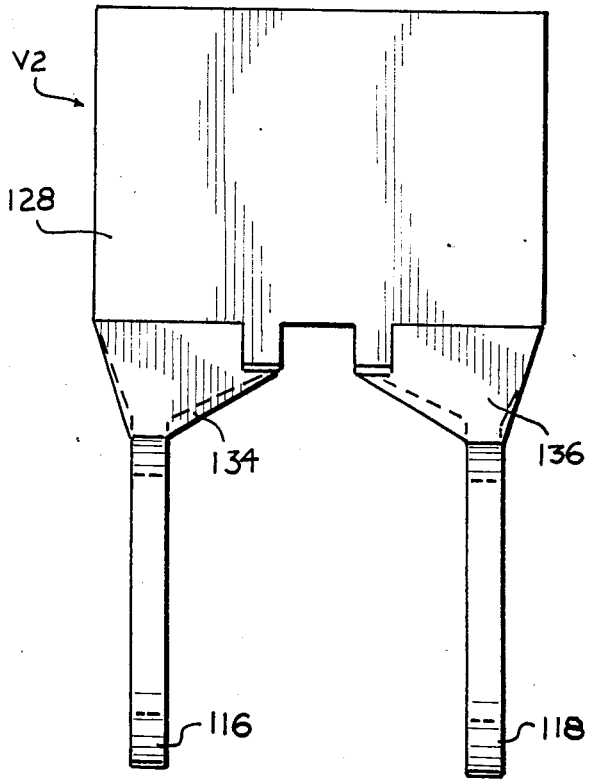

Referring to FIGS. 7–9, the configuration of the remaining vanes are shown. In FIG. 7, the configuration for vane V2 is illustrated; in FIG. 8, the configuration for vanes V3 and vanes V4 are illustrated; and in FIG. 9, the configuration for vane V5 is illustrated. The construction of vanes V2–V5 are very similar to that of vane V1 as described previously, although it should be noted that the separation between the O-shaped bearing members may differ.

More specifically, the O-shaped bearing members 116 and 118 of vane V2 are separated by a lesser distance than the O-shaped bearing members 100 and 102 of vane V1. The O-shaped bearing members 120 and 122 of vane V5 are separated by a much lesser distance than the O-shaped bearing members of either vane 1 and vane 2. The separation of the O-shaped members 124 and 126 of vanes 3 and 4 are approximately the same as that of vane V5, but they are offset from the center. The vanes V3 and V4 are essentially mirror images of each other, where one will be offset from the center in one direction, and the other will be offset from the center in the other direction.

The blades 128, 130, and 132 of vanes V2–V4 are substantially the same size and configuration as blade 98 of vane V1. The connecting sections 134–144 of vanes V2–V5 serve the same functions as the connecting sections 104 and 106 of vane V1, but vary slightly in configuration to accommodate the different positionings of the O-shaped bearing members.

As best seen in FIG. 2, the offset of the various O-shaped bearing members of vanes V1–V5 permit the vanes to be simultaneously hinged to bearing member 26. That is, the inner surfaces of the O-shaped members are bearing surfaces that engage the circumference of the bearing member 26 in a staggered leaf manner, much the same as the plate members of a hinger are attached to a hinge pin. The position of the blades V1–V5 are always substantially radial to rotary shaft assembly 20.

Referring to FIG. 10, rotor assembly 30 includes the drive plate 28. Drive plate 28 has a disk shaped body 146 provided with a splined hole 148 which engages the splined core 24 of rotary shaft assembly 20. The drive plate 28 is "crowned" in that it includes a number of projections 150 on the upper and lower surfaces of body 146. It is these projections 150 which engage the shoulder sections 108 and 110 of the vanes V1–V5.

The operation of variable displacement pump 10 will be discussed with general reference to the figures. The housing 12 of pump 10 is firmly coupled to a stationary surface, and rotary shaft assembly 20 is coupled to a motor or other suitable torque producing mechanism. It will be assumed for the purposes of discussion that the rotary shaft 20 is rotated in a counterclockwise direction as seen from FIG. 1, although it should be clear that the rotary shaft assembly 20 could also be rotated in the opposite direction.

As the rotary shaft assembly 20 is rotated, one of the projections 150 of drive plate 28 will engage a shoulder section of one of the vanes V1–V5, causing the vane to rotate with the rotary shaft assembly 20. The rotary force on the vane is transmitted to the rotor assembly 30 through a cylindrical bearing 33. The rotation of the rotor assembly 30 causes the other four vanes to also rotate with the rotary shaft assembly 20.

Since the rotor assembly 30 has an axis of rotation $A_s$ which is offset from the main axis of rotation $A_p$, there is a volume differential between the rotor assembly 30 and the surface 14 in the upper part of the pumping chamber 15 and in the lower part of the pumping chamber 15. As best seen in FIG. 1, extended vanes V5 and V1 will force fluid from orifice 16 towards orifice 18, while the vanes V2–V4 are substantially retracted within the rotor assembly 30.

The pump 10 forces fluid from orifice 16 to orifice 18 due to the counterclockwise rotation of rotary shaft assembly 20 and the position of rotor assembly 30. The direction of flow can be reversed, i.e. where fluid is forced from orifice 18 to orifice 16, by changing the direction of rotation of the rotary shaft assembly from counterclockwise to clockwise. However, this would be inconvenient since it would require the reversing of the direction of rotation of the motor driving rotary assembly 20. Instead, adjustment shaft 39 can be rotated to change the relative positions of axes $A_s$ and $A_p$.

When the axis $A_s$ is above the axis $A_p$, as shown in the figures, the flow will be from orifice 16 to orifice 18 with a counterclockwise rotation of rotary shaft assembly 20. When $A_s$ and $A_p$ are coaxial, there will be no fluid flow between orifice 16 and orifice 18. If axis $A_s$ were adjusted to be below axis $A_p$, the direction of fluid flow would be reversed, i.e. from orifice 18 to orifice 16.

It should be noted that it is therefore possible to smoothly vary fluid flow from maximum in a first direction, to zero, to a maximum of the other direction, and back again without varying in any way the speed or direction of rotation of the motor driving pump 10.

The variable displacement pump 10 can also be used as a motor by providing a pressurized fluid source at either orifice 16 or orifice 18. The output of the motor would then be the rotary shaft assembly 20. The speed and direction of the rotary shaft assembly 20 would be smoothly variable by means of adjustment shaft 38 between a maximum in a first direction, to no rotation at all, and to a maximum in a second direction even though the fluid flowing into either orifice 16 or orifice 18 is of constant pressure and direction.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A variable displacement machine comprising:

a housing provided with a chamber having a substantially cylindrical surface and a pair of orifices opening on said chamber;

rotary shaft means extending into said housing and having a primary axis of rotation;

a plurality of vane means having first ends coupled to said shaft means for rotation therewith, said vane means extending substantially radially from said shaft means, said vane means having second ends which sweep along said substantially cylindrical surface as said shaft means rotates;

rotor means disposed within said chamber around said shaft means and within said cylindrical surface, said rotor means having a secondary axis of rotation which is substantially parallel to said primary axis of rotation, said rotor means being provided with a plurality of apertures, where said vane means extend through said plurality of apertures such that said rotor means rotates with said vane means and said shaft means; and an adjustment means for adjusting the position of said rotor means relative to said primary axis, said adjustment means including an outer eccentric member, an inner eccentric member and having a means for rotating said eccentric members in counter-rotating directions, said outer member having a first outer surface in engagement with the cylindrical surface of said chamber and having a first inner surface which is eccentric relative to said first outer surface, said inner member having a second outer surface in engagement with said first inner surface and having a second inner surface in engagement with said rotor means, said second inner surface being eccentric said second outer surface.

2. A variable displacement machine as recited in claim 1 wherein said rotary shaft means includes drive means adapted to engage at least one of said vane means as said shaft means rotates.

3. A variable displacement machine as recited in claim 1 wherein said first ends of said vane means each have at least one O-shaped member, said O-shaped members coupled to said rotary shaft means in a staggered leaf manner.

4. A variable displacement machine as recited in claim 1 wherein said adjustment means includes a gear assembly for counter-rotating said outer member and said inner member.

* * * * *